US007090028B2

(12) United States Patent
Adiga et al.

(10) Patent No.: US 7,090,028 B2
(45) Date of Patent: Aug. 15, 2006

(54) FIRE SUPPRESSION USING WATER MIST WITH ULTRAFINE SIZE DROPLETS

(75) Inventors: Kayyani C. Adiga, Macon, GA (US); Rajani Adiga, Macon, GA (US)

(73) Assignee: Nanomist Systems, LLC, Warner Robins, GA (US)

( * ) Notice: Subject to any disclaimer, the term of this patent is extended or adjusted under 35 U.S.C. 154(b) by 186 days.

(21) Appl. No.: 10/247,147

(22) Filed: Sep. 19, 2002

(65) Prior Publication Data

US 2003/0051886 A1 Mar. 20, 2003

Related U.S. Application Data

(60) Provisional application No. 60/323,399, filed on Sep. 19, 2001.

(51) Int. Cl.
*A62C 2/00* (2006.01)

(52) U.S. Cl. ..... 169/47

(58) Field of Classification Search ..... 169/43, 169/44, 45, 47, 48, 49
See application file for complete search history.

(56) References Cited

U.S. PATENT DOCUMENTS 4,328,867 A * 5/1982 Heath ..... 169/58
4,378,851 A 4/1983 deVries
5,088,560 A * 2/1992 Fawal ..... 169/28
5,211,336 A 5/1993 Kaidonis et al.
5,217,165 A 6/1993 Takahashi et al.
5,323,861 A 6/1994 Kaidonis et al.
5,518,179 A 5/1996 Humberstone et al.
5,541,627 A 7/1996 Quate
5,597,044 A 1/1997 Roberts et al.
5,894,891 A * 4/1999 Rosenstock et al. ..... 169/28
6,164,382 A * 12/2000 Schutte et al. ..... 169/43
6,390,203 B1 5/2002 Borisov et al.

* cited by examiner

*Primary Examiner*—Christopher Kim
(74) *Attorney, Agent, or Firm*—Brian D. Bellamy

(57) ABSTRACT

An improved method and apparatus for producing an extremely fine micron and sub-micron size water mist using an electronic ultrasonic device that produces the mist at ambient-pressure and delivering the mist for application in suppressing fire. A piezoelectric transducer is arranged to produce a water mist having at least a portion of sub-micron size droplets. The water mist is produced by high frequency pressure waves or ultrasonic waves of predetermined or variable frequency, including frequencies which may exceed 2.5 MHz. The water mist is directed to a firebase to be self-entrained by the fire's flame. The momentum provided the water mist in directing the mist is minimized to enhance the ability of the fire to entrain the mist, and the flow of the carrier medium is usually directed tangentially about the water fountain creating the mist. Further, the throughput and concentration of the mist is controlled to ensure that the entrained mist will be sufficient to cool and suppress the fire. The water mist may be effectively utilized for mitigating blast and reducing over pressures. The fine water mist may also be utilized for humidification because of its fast vaporization and efficient cooling behavior. The apparatus may be modified in its physical design and direction of output, and the method may be modified by adjusting the throughput of mist, composition of mist, concentration of mist, and momentum of mist, whereby fire may be suppressed under many different scenarios.

4 Claims, 2 Drawing Sheets

FIRE SUPPRESSION USING WATER MIST WITH ULTRAFINE SIZE DROPLETS

CROSS REFERENCE TO RELATED APPLICATIONS

The present Application claim priority of U.S. provisional application No. 60/323,399 filed Sep. 19, 2001.

BACKGROUND OF THE INVENTION

1. Field of the Invention

The present invention relates to suppression of fire by extremely fine droplet water mist and more particularly, but not by way of limitation, to an improved method and apparatus for producing an extremely fine sub-micron size water mist using an electronic ultrasonic device that produces the mist at ambient-pressure and delivering the mist for application in suppressing fire.

2. Description of the Prior Art

Water based fire suppression systems have been in existence for many years. However, such systems were mostly replaced and the technology forgotten because of the advent of halon gas systems in the 1960's. In recent years, it has been discovered that halon gas is not environmentally safe, and its continued use has been banned due to its alleged potential to deplete ozone in the atmosphere. Thus, there is an urgent need for an alternative fire suppression system, which is effective and environmentally friendly and safe to use.

Because of several favorable properties, water mist has been reconsidered as a potential agent to replace halon gas. Water is environmentally friendly with no known toxic properties. Water has a specific heat of 4.18 J/g, and a high latent heat of vaporization of 2260 J/g that assist in cooling a flame. Finally, water is readily available and cost efficient.

Water mist suppresses fire through different mechanisms. Each mechanism exhibits a different degree of influence on the overall suppression efficiency of a water mist. The four important operating mechanisms are heat extraction, oxygen displacement, radiant heat attenuation, and dilution of the vapor/air mixture. Heat extraction and cooling of the flame has the maximum effect on the efficiency of fire suppression and the other mechanisms usually supplement the heat extraction mechanism. The inventors have found through computer simulation and experimentation that the success of water mist in its application to fire suppression depends on the ability to produce nearly nanometer-scale and sub-micron size droplets of water mist and deliver the mist to various fire scenarios. Extremely small droplets vaporize instantaneously and absorb energy to extract heat from the flame. Water mist droplets of larger diameters vaporize more slowly and are not as efficient in suppressing fires. Also, larger droplets are not as easily entrained into the fire and need additional momentum if the mist has to be introduced away from the firebase.

An extremely small amount of water is needed for suppressing a fire using extremely small sub-micron droplet mist because of considerable volume expansion accompanied by the transition from liquid state to mist (about 1700 times). This water expansion is based on the ratio of the density of liquid water and the gas-like nanoscale mist.

An extremely fine mist of sub-micron size water droplets avoids several of the disadvantages normally associated with the conventional water mist fire suppression technology. For instance, typical water mist applications having larger droplet size may cause a kinetic effect on flames causing flare-up from the water droplets striking the fuel surface. Further, because of slower vaporization and greater momentum needed, larger droplets wet surfaces within the area of application, conduct electricity and often damage items. Thus, a key to the success of water mist technology is the use of very fine nanometer-scale sub-micron water mist produced using a cost-effective and ambient-pressure method.

Previously, fine water mist production for fire suppression has been an expensive technology in terms of installation and maintenance. These prior art systems have included one or more expensive components such as high pressure storage of fluids, conduit pipes often under high pressure, and pumps providing pressurized fluid to specialized atomizer nozzles. Besides the expense of the components these components and conduit piping require valuable space for installation. Space may be limited for certain applications such as marine vessels, machine space, and computer data centers.

In addition to the expense of installing known water mist fire suppression systems, these systems present safety and mechanical concerns. In particular, pressurized systems are subject to leaks and hazards of bursting posed by retaining fluids under pressure. These systems require nozzles that are subject to clogging because of the small nozzle diameters and are also expensive and difficult to construct because of their precise specifications.

Even with state-of-the-art mechanical atomizers, the droplet size obtainable in these prior art systems is on the order of 50–200 microns. For many applications, these droplets are effective in cooling the flame. However, the water mist droplets may still wet surfaces and cause electrical conductance. This limits the ability to use water mist fire suppression in computer and data center applications or in precious item preservation rooms in libraries and museums. Moreover, the mechanical atomization technology required by conventional fine water mist fire suppression systems is still very expensive.

The prior art mist generation methods for fire suppression involve well-documented methods such as pressurized water or twin-fluid atomizers. Single fluid pressure based atomizers use water stored or pumped at high pressure (40 to 200 bar) and spray nozzles with relatively small orifice sizes. Twin-fluid systems use air, nitrogen, or other gases to atomize water at a nozzle. Although rare, there are some references to utilization of extremely high (hypersonic velocity) gas streams to generate ultrasonic waves to generate mist for suppressing fires and explosions. For instance, U.S. Pat. No. 4,378,851 to Egbert deVries describes ultrasonic nozzles of a general type in which a gas orifice penetrates a liquid filming surface. The method uses a high velocity gas stream to shear the thin layer of liquid and atomizing it. Others, U.S. Pat. Nos. 5,211,336 and 5,323,861, teach a method of producing a mist using a compressed air stream, and U.S. Pat. No. 5,597,044 teaches using a carrier gas having supersonic velocity. All the prior methods use either pressurized water or compressed gas as means of atomizing water to produce a water mist. As a result, these prior technologies produce atomized water mist using mechanical means that are not user friendly and are not very economical for generating water mist for fire suppression.

Thus, an objective of this invention is to provide a water mist fire suppression method using an electronic ultrasonic device to produce a water mist having sub-micron diameter water droplets.

Another objective of the invention is to provide a fire suppression device using an electronic ultrasonic device to produce a water mist and optionally powered by line fed electric power or a portable power source such as a battery.

Another objective of the invention is to provide a fire suppression method using a mist generation method that does not need pressurized water or gas.

Another objective of the invention is to use a method of generating mist for fire suppression that does not use an atomizing nozzle and is free from nozzle clogging and flow blockage.

Another objective is to provide a device and method to deliver a sub-micron diameter mist to a fire such that the mist that is entrained by the fire.

Another objective is to provide a mist for fire suppression without mechanically imparting excessive momentum to the mist.

Another objective is to provide a mist for fire suppression in which the mist is introduced from the base of the fire.

Another objective is to minimize water usage and the quantity of mist needed to suppress a fire by delivering the mist to the most reactive zone in the fire base using very low injection velocity.

Another objective is to reduce the quantity of water needed for suppressing a fire by several orders of magnitude compared to conventional mists by using water mist having submicron diameter droplets.

Another objective is to deliver a sub-micron mist to a fire such that the mist will vaporize before impact with surface areas and not wet surface areas or equipment.

Another objective is to provide a tangential flow of air or gas for carrying the mist out of the mist generator without affecting the centerline mist producing water fountain.

SUMMARY OF THE INVENTION

This invention relates to a fire suppression method based on water mist generated by an electronic high frequency ultrasonic device and differs from prior methods of producing water mist using high-pressure elements or high velocity gas streams. More specifically, the present invention discloses the application of a mist generation method that does not use nozzles to create an ultra fine mist, and, thus, is free of nozzle clogging and does not require water at elevated pressure or compressed gas. The advantageous features of the invention positively enhance the safety and economics of fire protection and suppression, while improving effectiveness.

In the present method, a water-bed at ambient pressure is subjected to ultrasonic waves driven by a piezoelectric transducer. The oscillating frequency of the transducer provides the ultrasonic waves that atomize the water to produce droplets less than 1 micron in diameter, for instance 500 nanometers. Typical transducers available commercially are used in medical applications, cleaning, and humidifying and operate with oscillating frequencies up to 2.4 MHz. These transducers produce extremely small droplets, which could measure less than 1 micron with some modification of the design. For generating largely sub-micron size mist, as required in the present invention, these transducers may be modified and adapted to provide still higher oscillating frequencies.

In addition to increasing the frequency of the transducer, there are other factors that can be varied to decrease the droplet size of the resulting water mist, such as by reducing the surface tension of the water and increasing the water-bath temperature or both. The sensible enthalpy increase due to elevated water-bath temperature is not significant compared to the large magnitude of latent heat of vaporization of water. Based on this, increasing the bath temperature is an efficient way of reducing the mist droplet size. In fact, the natural heating taking place during the oscillator functioning helps to achieve this beneficial property.

The sub-micron diameter water mist droplets created by the invention are created at ambient pressure. Therefore, the mist is created cost effectively because no expensive technology is required, and the mist also is created very safely and quietly. Instead of using noisy and dangerous high-pressure equipment, the water mist is produced by ultrasonic oscillations provided by electronic means without need for pressurized fluids or sophisticated nozzles.

The very fine mist generated by the ultrasonic waves is transported and delivered to a fire by gravity, a carrier gas comprised of inert gas, or air. Using air, the mist could also be pulled out of the generator using a fan at the outlet without using any additional carrier fluids. Each of the preferred delivery methods avoid the problems associated with excess momentum that exist in prior art mist delivery systems using high velocity nozzles and the like.

The specific embodiments of the apparatus and delivery method utilized in the invention may vary in accordance with the particular fire suppression application chosen. Proposed application areas include computer data storage areas, machinery space, ground vehicles, aircrafts, ships and submarines, a variety of indoor fires, and a variety of outdoor fires. Special cases may involve application for wildfires, such as in forests, where mist curtains may be installed at calculated distances to absorb the heat energy and diffuse the thermal wave propagation. These various application areas may be treated using fixed systems, hand-held portable devices, or indoor-outdoor portable units. Regardless, each specific system should be designed utilizing the present method of generating a water mist and having a suitable delivery setup for the specific fire scenario.

Because the sub-micron diameter droplets are so fine, the droplets do not wet surface areas when applied to a fire. Instead, the droplets rapidly vaporize to cool and suppress the fire. Likewise, the droplets will not come to rest on items and cause electrical conduction or damage precious items. With these advantages of the invention in mind, the method and apparatus for generation of a sub-micron droplet mist for application in fire suppression has the potential to replace halon and other chemicals presently used in place of halons for fire suppression.

Ultrasonic atomizers consisting of an oscillator and atomization needle, or probe, combination are alternatives to demonstrate the concept of producing mist and are commercially available. However, these atomizers are not cost-effective and would be prohibitively expensive for use in fire suppression. The oscillator and needle combination uses similar principles as described herein, but these available atomizers have low throughput and are specifically designed for low momentum coating or spraying applications. In these, the liquid travels through a probe through a narrow bore and spreads out as a thin film on the atomizing surface. The oscillations at the tip of the probe discharge the liquid into micro-droplets, and then eject them to form a gentle, low viscosity mist. The liquid viscosity may be a limiting factor, and the commercial ultrasonic atomizers of this type are expensive and cannot be widely used for large-scale applications such as fire suppression or protection.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Referring to the figures, the present invention is shown in alternative embodiments. In particular the figures illustrate two embodiments of a device having a mist generator 8 for producing an ultra fine mist having sub-micron droplets. The embodiments disclose various ways of delivering the mist to a fire consistent with application of the present invention to various fire scenarios.

Figure 1:
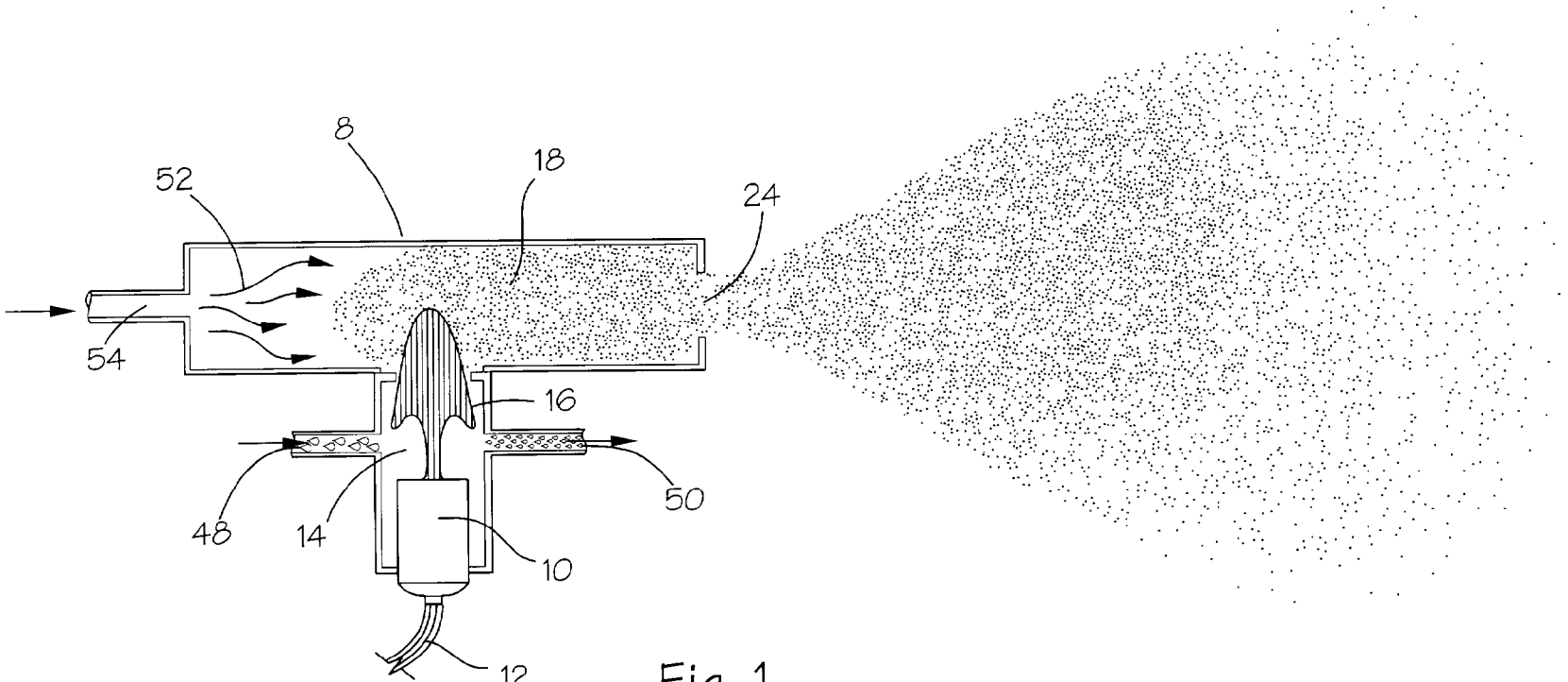
FIG. 1 is a schematic elevation view of an exemplary water mist generator for fire suppression showing the ultrasonic device generated nanometer-size water mist system of the present invention.

As shown in FIG. 1, a piezoelectric transducer 10 connected to a suitable power source via connections 12 is submerged in a bath of water or arranged in physical communication with water 14. The piezoelectric transducer 10 receives an electrical signal and converts electrical oscillations into high frequency mechanical vibrations, which facilitate atomization of fluids by producing ultrasonic pressure or sound waves with rarefaction and compression cycles. The required high frequency pressure waves may be provided by a high frequency wave generating laser device also. Above a certain limit, rarefaction produces cavitations resulting in bubbles that expand during the negative pressure excursion and implode violently during the positive excursion. The cavitations cause the imploding bubbles to surface out as small droplets during compression and form a fog-like mist. Therefore, the ultrasonic waves produced by the high frequency vibration cause atomization of the water into a cloud of droplets.

Figure 3A:
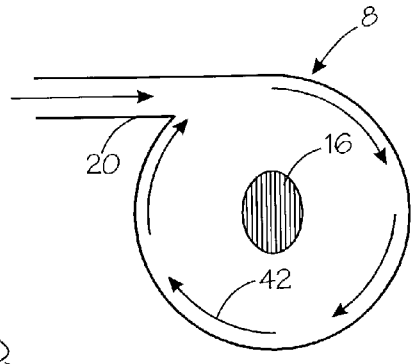
FIG. 3 is a schematic of top view of flow velocity vectors at the fan or gas ingress and mist egress planes.
Figure 3B:
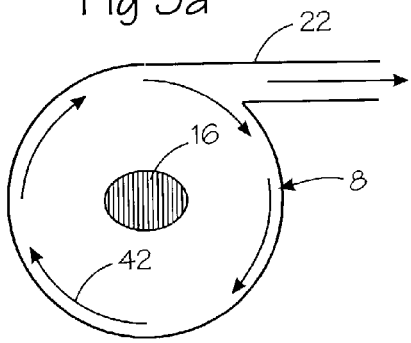

Above the oscillating disc of the transducer 10, a water fountain plume 16 is formed with heights varying from a few inches to a foot depending on the oscillator size and frequency. Extremely small droplets of water 18 or mist originate and come out of this fountain 16. Attempts to suppress this fountain 16 or block the flow results in either the termination or reduction of mist 18 throughput. As a result, if a fan is used to push the mist out of the generator container 8, the air-flow will have the tendency to disturb the fountain flow. Flow behaviors at the entrance into the flow ingress 20 of the mist generator 8 and leaving at the mist egress 22 should be well organized as shown in FIG. 3. To optimize the function of the invention, well-organized flow behavior will typically be a feature of the invention discussed further herein.

The water droplet 18 size produced by the atomization process depends on the surface tension of the water 14, the density of the water, and the frequency of oscillation of the transducer 10. The droplet 18 diameter decreases with decreasing surface tension of the liquid 14. The droplet 18 size also decreases with increasing liquid 14 temperature. Also, droplet 18 diameter decreases with increasing density of liquid 14 and frequency of oscillation of transducer 10. In order to produce a mist 18 having a significant proportion of droplets having droplet diameters less than one micron as recommended by the invention, the frequency produced by the piezoelectric transducer 10 herein may be greater than usual. The approximately 1 to 2 MHz frequencies used in prior functions is adequate for producing mists having 1–10 micron particles useful in humidifiers, foggers, cleaning, and other functions. However, frequencies greater than 2.5 MHz may be necessary in certain cases to produce the sub-micron particle mists 18 useful in the fire suppression method taught by the invention, and some modification to present commercial transducers may be required unless other methods are used as suggested above to decrease the mist droplet 18 diameter produced. A variable frequency oscillator may be utilized to obtain a broader spectrum of droplet 18 size.

As indicated before, smaller diameter droplets 18 can be produced by decreasing the surface tension of the water 14, which may be accomplished by adding surfactants or surface-active agents or by some other means. In addition, the temperature of the water 14 may be elevated to decrease the droplet 18 diameter produced. During the process of oscillations and sound wave propagation some heating takes place, which promotes the further reduction of droplet 18 size.

The cloud-like collection of extremely small droplets 18 forming the mist created by the atomizing process hang in the air like a dense gas and slowly succumb to the forces of gravity without any other impetus provided. The impetus provided and, therefore, the mist delivery method used in the invention is an important factor in the effectiveness of the mist 18 in fire suppression because the mist 18 should be supplied to the firebase. Therefore, the delivery method used by the invention is customized according to the particular fire suppression application, such as open fires, room fires, machinery space, or other scenarios. The delivery of the mist 18 may vary with respect to direction, throughput, momentum imparted to the mist 18, the composition of carrier gas that may be used, and the mist concentration in the mass flow. The mist generating devices 8 in the figures show representative delivery outlets 22 and 24.

The delivery direction of the mist 18 may be manipulated by the location of outlets 22 and 24 and the application of a fan or other device to direct the exiting mist 18. In some fire suppression applications, the mist 18 will exit the generator 8 and be gravity fed to a fire and self-entrained. While in other applications, the mist 18 will need to be transported to a fire by a propellant carrier inert gas, such as nitrogen or carbon dioxide. Or, the mist 18 may be transported by air using a fan to push the mist 18 toward the firebase and create a suitable flow using the optimum velocity of the diverging airjet. The proportion of mist 18 to carrier gas or air has to be properly manipulated for sufficient mist ratio to successfully suppress the fire, and the throughput of the mist 18 must be sufficient to suppress a fire.

Balancing the momentum of the mist delivery is an important feature of the present method. The mist momentum should be low enough that a fire can self-entrain the mist 18 as the mist 18 is delivered to an area surrounding the application. The injection momentum of the mist 18 should be just enough to reach the firebase. If the mist momentum is too high, the cold mist 18 will not be entrained by the fire's buoyancy force and will not be effective in suppression. If the mist momentum is insufficient, the mist 18 may not reach the vicinity of fire and be entrained into the firebase.

Figure 2:
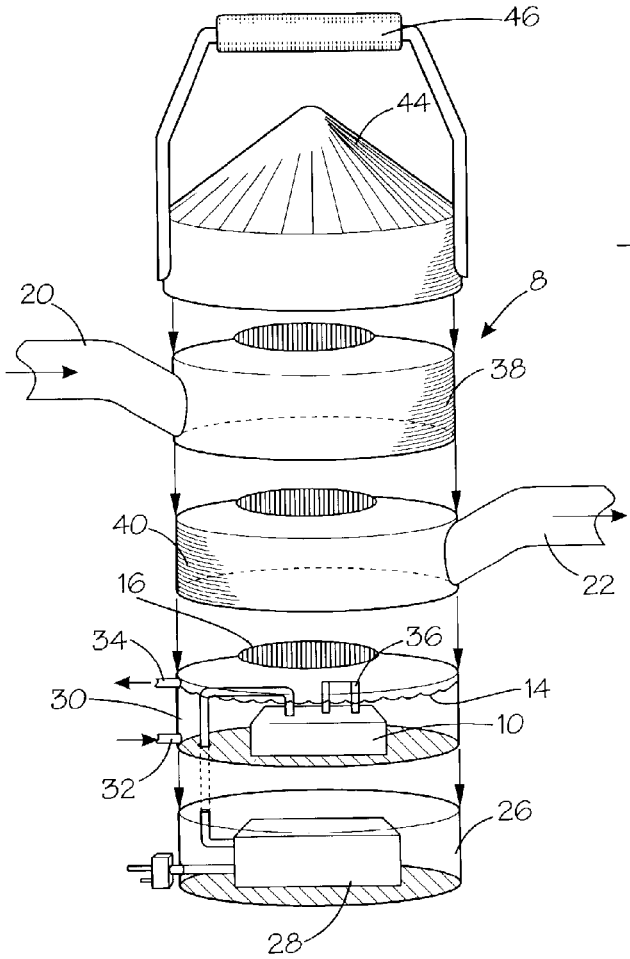
FIG. 2 is a schematic elevation view of a fire suppression device using an electronic ultrasonic device to generate a nanometer-size water mist.

A schematic of an embodiment of the mist generation unit 8 illustrating the invention is shown in FIG. 2 customized to provide a suitable flow of mist 18 for some fire suppression applications. A first bottom section of the unit 8 provides a power supply section 26. This section contains a power-utility box 28 including 48 V step-down transformer. The power box 28 and transformer is operably connected to a transducer 10 contained within an second section, referred to herein as the mist generation section 30.

In the embodiment shown in FIG. 2, the transducer 10 is submerged in a water bath 14. The mist generation section 30 may include an ingress inlet 32 and egress outlet 34 to provide water to create a water reservoir 14. In some applications, a sensor 36 may be provided as shown in this second section 30 to monitor the level of the water reservoir 14, and a system may be provided for controlling the inlet 32 and outlet 34 of the water reservoir 14 to adjust the water level accordingly.

A mist egress or mist outlet section 40 is situated above or near the mist generation section 30, and an air or carrier gas flow ingress section 38 is situated above or near the mist egress section 40. Alternatively, the relative positions of mist egress section 40 and gas flow ingress section 38 can be interchanged, namely, the mist egress section 40 can be above the gas flow ingress section 38. The mist 18 either flows out of the unit as a result of gravity or may be pushed by a secondary force. A fan may be provided to communicate with the mist outlet section 40 via the flow ingress section 38 and direct the mist 18 through the egress spout 22 at the desire momentum and proper air to mist mix. Alternatively, a compressed inert gas or compressed air may be arranged to communicate with the mist egress section 40 via a conduit of the flow ingress section 38 such as the inlet spout, represented by the ingress inlet 20.

Whether a fan or compressed air or any gas is used to direct the mist 18 to the firebase in the present invention, the flow 42 of carrier medium through the mist generator 8 has to be well organized to avoid disturbing the water fountain 16 extending upward from the water bath or reservoir 14 as discussed above. One way to avoid flow 42 disturbing the fountain 16 is to keep the ingress inlet 20 and egress outlet 22 for gas and fluid flow 42 tangential to the container 8 as shown in FIG. 3. In the embodiment shown, the flow 42 of gas and fluid circulates peripherally of the water fountain 16, while the center of the mist generator 8 where the water fountain 16 exists is relatively quiet. Assuming the fountain 16 is at the center of the water bath 14, the flow 42 of gas and fluid will not affect the flow of the water fountain 16 producing the mist 18. FIG. 3 shows the flow vectors 42 along the side of the cylindrical container 8 and finally pushing the mist 18 out of the container 8 at the selected outlet 22 location.

A rectangular geometry does not accommodate well the type of tangential wall-side flow 42 shown in FIG. 3. Therefore, the generator unit 8 should preferably have a cylindrical geometry as shown in FIG. 3 rather than rectangular. However, other variations may be beneficial under certain applications with proper care to ensure the water fountain flow 16 is not disturbed by the flow of mist carrier medium. For instance in FIG. 1, a water flow is provided in through an inlet 48 and outlet 50 that communicates with the transducer 10 to produce the mist 18. The mist 18 flows up from the water fountain 16 and is provide impetus for direction to the firebase by the flow 52 of carrier medium through the flow inlet 54, which is situated above the water fountain plume 16 so as not to disturb it.

Some existing high-throughput humidifier designs use a fan to directly push the mist upwards out of the container. As a result of direct air current impinging on the water fountain in these high-throughput humidifiers, the mist coming out of the humidifier contains large proportions of coarse water droplets. This mist containing coarse droplets is not efficient for fire suppression application. Moreover, the fan speed of these commercial humidifiers is not calibrated to transport at least 0.8 to 0.9 mass fraction of mist, and the momentum of mist coming out of commercial humidifier units is not controlled to match a specific fire application. Thus, the commercially available high-throughput humidifiers do not possess the mist throughput and delivery strategies discussed herein and would not be well suited or contemplated for use in fire suppression.

While a preferred embodiment of the invention is disclosed, various alternatives for configuring the device will be found through development within the scope of the present invention. In particular, the locations of the mist outlet section 40 and carrier gas inlet section 38 may be switched. For example, the carrier gas inlet 38 may be below the mist outlet section 40.

The power supply section 26, mist generation section 30, and mist outlet section 40 of the mist generation unit 8 are arranged vertically in FIG. 2 and provided a top 44 having a handle 46. The unit 8 could be arranged having predominately horizontal or vertical construction. An independent portable power source may be added to the mist generation unit 8 configuration in desirable applications. For example, a rechargeable battery may be provided for a portable mist generation unit 8, such as a hand-held unit, to be used as indoor or outdoor portable fire extinguishers or like those sometimes used in open room fires.

Adding water-soluble chemical additives to the water bath 14 may enhance the effectiveness of water mist 18 generated by the fire suppression unit. Also, water immiscible liquid additives may be added to the water bath 14 to enhance fire suppression because the cavitations and atomization process will cause the additives to uniformly mix with the water mist 18 generated. Some examples include the formation of macro-emulsions or micro-emulsions containing water and other water immiscible fire extinguishing chemical liquids mixed during ultrasonic oscillations. These mechanical micro-emulsions do not need surfactant chemicals to hold the droplets inside the microstructure, which offers the unique advantage of a hybrid micro-emulsion of a chemical suppression liquid and water to be used as a fluid. The resultant hybrid fluid system provides opportunities such as to reduce the effective weight of water to be carried in aircrafts for in-flight fire situations.

There are many fire suppression scenarios in which the present method and apparatus may be used effectively. In lieu of an exhaustive list of applications, several exemplary embodiments and scenarios are presented for consideration without intending to exclude other fire suppression applications in which the invention would be useful. First, the invention may be used in portable hand-held fire extinguishers. In these portable hand-held units, the desired water mist 18 may be produced at ambient pressure without storing fluids under pressure. Refilling portable unit could be accomplished using a closable opening to receive tap water from a faucet. Further, the portable unit may be battery operated.

In a second embodiment, the invention may be used in computer/electronic data storage rooms and electronically sensitive areas. The ultra fine sub-micron water mist 18 generated by the invention is especially advantageous to this application because the water mist 18 will not deposit or accumulate on sensitive electronic equipment. In this embodiment, the water mist 18 may be produced in a container, such as the mist generation unit 8, and the mist 18 flowing out of the container could be dispersed using a fan or an induced inert gas flow. In fact, for many computer data center rooms, the raised bottom floor structure therein provides a good opportunity to implement the present mist delivery system. Because the air-ducts in these type data centers are in the floor and the flow of air is always upwards, a water mist 18 using the present system can be easily dispersed from the bottom floor. Optionally, a system based upon the invention designed for this environment may be situated in the ceiling work of a room for selective distribution by gravity to be self-entrained by the fire.

In a third embodiment, the invention may be used in machinery space such as large machinery areas, hangers, turbines, machine shops, or switch rooms. The water mist may be produced by the mist generation unit 8 and delivered to the fire location by fan or induced inert gas flow. Optionally, mist generators could be installed on a floor below the machine area to be self-entrained by a fire easily from below.

In a fourth embodiment, the invention may be used in ground vehicles, aircraft, ships and submarines. In all of these applications the mist 18 generated may be re-distributed by fans or induced inert gas flow depending upon space designed for. If the area may be totally flooded with the mist 18 and ventilation is secured, then the mist 18 may be gravity fed and entrained by the fire flow field.

In a fifth embodiment, the invention may be used to suppress open fires. In this scenario, the mist 18 is delivered to the firebase by a directed very low velocityjet having a mist concentration of at least 75–80% of the total mass flow.

In a sixth embodiment, the present invention may be used to block the propagation of forest fires. A mist curtain of desired thickness or several meters could be created in the direct path of propagation of the fire. The mist curtain would absorb energy from the leading edge of the fire and slows down the fire. By installing several layers of water mist curtains, the fire propagation rate could be considerably decelerated and finally brought to the complete stop.

In addition to fires, the fine water mist of this invention may be used to mitigate blasts and explosion processes or in humidification. Because of the extremely small droplet size, the mist 18 will absorb considerable energy and, therefore, reduce excessive over-pressures developed during a blast within a blast or explosion area. With regard to humidification, the extremely small droplets vaporize fast and provide cooling as well as the required humidity level in intended areas.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention as defined by the claims.

What claimed is:

1. A fire suppression method comprising the steps of:

a. providing a high frequency pressure wave to a reservoir containing water having a certain surface tension such that the high frequency pressure wave has interaction with the water;

b. heating the water in the reservoir prior to generating the mist;

c. generating a mist having a proportion of sub-micron diameter droplets from the interaction of the high frequency pressure wave with the water;

d. directing the mist toward a base of a fire;

e. providing a sufficient momentum to the mist for the fire to self-entrain the mist into the fire; and f. providing a sufficient throughput of mist to cool and suppress the fire.

2. A fire suppression method providing a reservoir containing water having a certain surface tension;

b. reducing the surface tension of the water in the reservoir by adding a surface-active agent to the water;

c. providing a high frequency pressure wave to the reservoir containing water such that the high frequency pressure wave has interaction with the water; d. generating mist having a proportion of sub-micron diameter droplets from the interaction of the high frequency pressure wave with the water;

e. directing the mist toward a base of a fire;

f. providing a sufficient momentum to the mist for the fire to self-entrain the mist into the fire;

g. providing a sufficient throughput of mist to cool and suppress the fire.

3. A fire suppression method comprising steps of:

a. providing a high frequency pressure wave to a reservoir containing water having a certain surface tension such that the high frequency pressure wave has interaction with the water;

b. generating a mist having a proportion of sub-micron diameter droplets from the interaction of the high frequency pressure wave with the water;

c. directing the mist toward a base of a fire in an electronic data storage r area and;

d. providing a sufficient momentum to the mist for the fire to self-entrain the mist into the fire;

e. providing a sufficient throughout of mist to cool and suppress the fire; and f. The momentum and the throughput of the mist is regulated to prevent moisture damage and loss of data.

4. A method of mitigating a blast or explosion process including the steps of:

a. providing a high frequency pressure wave to a reservoir containing water having a certain surface tension such that the high frequency pressure wave has interaction with the water;

b. generating a mist having a proportion of sub-micron diameter droplets from the interaction of the high frequency pressure wave wit the water;

c. directing the mist toward a blast or explosion area; and d. providing a sufficient throughput of mist to absorb energy produced by the blast or explosion process.

* * * * *